US006357120B1

(12) United States Patent
Khachatoorian et al.

(10) Patent No.: US 6,357,120 B1
(45) Date of Patent: Mar. 19, 2002

(54) FRONT-LOADING ADJUSTABLE SAFETY UTILITY KNIFE WITH SAFETY QUICK-RELEASE LOCK

(75) Inventors: Zareh Khachatoorian, Northridge, CA (US); Qui Jian Ping, Hangzhou (CN)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/374,523

(22) Filed: Aug. 14, 1999

(51) Int. Cl.[7] ..... B26B 5/00

(52) U.S. Cl. ..... 30/162; 30/337; 30/338; 30/339

(58) Field of Search ..... 30/162, 337, 338, 30/339

(56) References Cited

U.S. PATENT DOCUMENTS

| | | | | | |
|---|---|---|---|---|---|
| 3,345,743 | A | * | 10/1967 | Paulson et al. | |
| 3,845,554 | A | | 11/1974 | Jonis | |
| 3,872,591 | A | | 3/1975 | Quenot | |
| 4,277,888 | A | * | 7/1981 | Szabo | 30/162 |
| RE30,733 | E | * | 9/1981 | Quenot | 30/162 |
| 4,575,940 | A | * | 3/1986 | Wenzel | 30/337 |
| 4,621,425 | A | * | 11/1986 | Stoutenberg | 30/162 |
| 5,025,558 | A | * | 6/1991 | Gilbert | 30/162 |
| 5,168,630 | A | * | 12/1992 | Weber | 30/337 |
| 5,495,670 | A | | 3/1996 | Quinn | |
| 5,644,843 | A | | 7/1997 | Young | |

* cited by examiner

*Primary Examiner*—M. Rachuba
(74) *Attorney, Agent, or Firm*—Lackenbach Siegel Marzullo Aronson & Greenspan, P.C.

(57) ABSTRACT

An adjustable safety utility knife includes an elongated ergonomically shaped handle formed of two elongate shell members each having a peripheral edge and an outer generally convex surface and an inner generally concave surface. The shell members are fastened at the peripheral edges along a vertical parting plane to form an elongated internal cavity. The handle defines a front end, a back end and an intermediate portion suitable for being gripped by a user and also defining top and bottom surfaces extending along opposite sides of the shell members along the peripheral edges. The handle has a slot-like aperture at the front end substantially aligned with the parting plane and dimensioned for passage of a flat cutting blade therethrough. A guide element within the elongated cavity guides the cutting blade between a first position for safely storing the blade fully inside the cavity and a second position for selectively extending the blade beyond the aperture to expose at least a portion thereof. A manually operated button is arranged on the top surface and coupled to the guide element for selectively moving the blade between the first and second positions. The guide element includes a carriage within the elongated internal cavity for supporting a flat cutting blade and guide elements on at least one of the inner generally concave surfaces for guiding the carriage and cutting blade carried thereby between the first and second positions. The carriage includes a locking element for normally locking a cutting blade mounted thereon to substantially fix the cutting blade against relative longitudinal movements between the cutting blade and carriage. The locking element includes an unlocking element the actuation of which releases the cutting blade to permit relative longitudinal movements between the cutting blade and the carriage. A blade release element on one of the shell members actuates the unlocking element when manual force is applied thereto, whereby application of a force on the release element releases the cutting blade and enables it to be withdrawn through the front end aperture.

4 Claims, 3 Drawing Sheets

FRONT-LOADING ADJUSTABLE SAFETY UTILITY KNIFE WITH SAFETY QUICK-RELEASE LOCK

BACKGROUND OF THE INVENTION

1. Field of the Invention

The present invention generally relates to hand tools and, more specifically, to a front-loading adjustable safety utility knife with safety utility knife with safety quick-release lock.

2. Description of the Prior Art

Utility knives are widely used in construction, business and hobby applications for cutting such materials as paperboard, wallboard, string and other objects. Commonly, such utility knives are in the form of an elongate hollow housing that can be gripped by the user along an intermediate portion thereof and into which there are placed trapezoidal flat cutting blades. The blades typically have a single cutting edge. The blade is typically slidably mounted on a carrier for movement between a retracted position within the housing and an extended position in which the cutting edge is at least partially exposed through a front end aperture or slot, the carrier being coupled to a manually operated element, such as a button positioned in a manner convenient to be actuated by the user's hand.

Many utility knives include a region within the housing for storing one or two additional blades that can be used to replace the operative blade when it becomes dull. In most cases a screw or similar means is used for attaching the two clam shell members together during normal use. When blades are to be replaced, the screw is removed, allowing the two shell members to be separated, and access is provide to the replacement blades.

A number of utility knife designs have been proposed that facilitate the removal, reversal or replacement of blades without separating the mating handle parts or shell members. Thus, in U.S. Pat. No. 3,845,554, a knife blade and handle are disclosed in which a leaf spring is mounted in the holder that supports projecting pins which are adapted to enter into two openings or notches in the blade. The leaf spring is manually movable between a blade clamping and a blade release position. However, with this design, when the handle parts are separated for any reason, the mechanical parts or components which position and move the blade can themselves be separated from and be dislodged from the handle, making it possible for these parts to be misplaced. The user must replace all the parts in their original positions prior to reassembly of the handle. This may be difficult and inconvenient due to the presence of a loose compression spring which is itself held in position by the leaf spring.

In U.S. Pat. No. 5,168,630, a blade carrier tool is disclosed which has a somewhat complicated construction in which a jaw partially pivots away under the control of a separate release mechanism provided at the rear of the handle to partially expose the blade. This release mechanism occupies a significant amount of space within the handle, rendering that space useless for storage of additional blades. The blade must additionally be manipulated in order to release the blade from the blade-retaining elements because of the small extent to which the jaw pivots to provide limited access to the interior of the tool. Also, in U.S. Pat. NO. 5,495,670, a utility knife is disclosed which includes a pivoted access panel which can be pivoted open to provide access to the front blade. However, the opening of this panel essentially releases the blade, which may drop out of the utility knife, there being nothing to retain the blade once the panel opens. This may create an unsafe condition if the blade falls out and the user tries to catch it with the user's hand.

In U.S. Pat. No. 5,644,843, a utility knife is disclosed which allows the active or operative blade to be lowered below the housing by controlling the position of a blade carrier. However, as in the previously mentioned patent, once the blade carrier is lowered below the knife handle, the blade is susceptible of being dislodged and falling out of the unit. Additionally, in this patented design, the same manually actuated button is used to slide the blade outwardly to the operative position as well as to release the blade. This may result in inadvertent movement of the button to a release position when such was not intended. By providing a design in which the blade can be dislodged with a singlehanded operation, there is the danger that the blade will be inadvertently dislodged, and injury to the user may result.

SUMMARY OF THE INVENTION

Accordingly, it is an object of the present invention to provide an adjustable safety utility knife which does not have the disadvantages inherent in known utility knives.

It is another object of the present invention to provide an adjustable safety utility knife which is simple in construction and economical to manufacture.

It is still another object of the present invention to provide a safety utility knife as in the previous objects which facilitates the insertion, reversing and replacement of the cutting blade.

It is yet another object of the present invention to provide an adjustable safety utility knife as in the present invention which allows simple and convenient insertion, reversal and replacement of a cutting blade through the front opening or aperture without the need to separate the clam shell members forming the handle of the knife.

It is a further object of the present invention to provide an adjustable safety utility knife which is safe and convenient to use and minimizes the probability that the user will be exposed to a blade that inadvertently falls out of the knife.

It is still a further object of the present invention to provide an adjustable safety utility knife which provides a carriage for transporting the cutting blade that can conveniently and safely release a blade for movement through the front aperture and which is in the form of a unitary assembly that incorporates springs and other components that can be inserted and removed from the knife as an unit or subassembly.

In order to achieve the above objects, and others which will become apparent hereinafter, an adjustable safety utility knife in accordance with the present invention comprises an elongated ergonomically shaped handled formed of two elongate shell members, each having a peripheral edge and an outer convex surface and an inner generally concave surface. Fastening means is provided for fastening such shell members at said peripheral edges along a vertical parting plane to form an elongated internal cavity. Said handle defines a front end, a back end and an intermediate portion suitable for being gripped by a user and also defining top and bottom surfaces extending along opposite sides of said front end substantially aligned with said parting plane and dimensioned for passage of a flat cutting blade therethrough. Guide means is provided within said elongated cavity for guiding the cutting blade between a first position for safely storing the blade fully inside said cavity and a second position for selectively extending the blade beyond said aperture to expose at least a portion thereof. A manually operated button is arranged on said top surface and coupled to said guide means for selectively moving the blade between said first and second positions.

Said guide means includes a carriage within said elongated internal cavity for supporting a flat cutting blade and guide elements are provided on at least one of said inner generally concave surfaces for guiding said carriage or cutting blade carrier between said first and second positions. Said carriage includes locking means for normally locking a cutting blade mounted thereon to substantially fix the cutting blade against relative longitudinal movements between said cutting blade and said carriage. Said locking means also includes an unlocking element, the actuation of which releases a cutting blade to permit relative longitudinal movements between said cutting blade and said carriage. Blade release means is provided on one of said shell members for actuating said unlocking element when manual force is applied thereto. Therefore, application of a force on said blade release means releases said cutting blade and enables it to be withdrawn through said end aperture.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows.

DETAILED DESCRIPTION OF A PREFERRED EMBODIMENT

Figure 1:
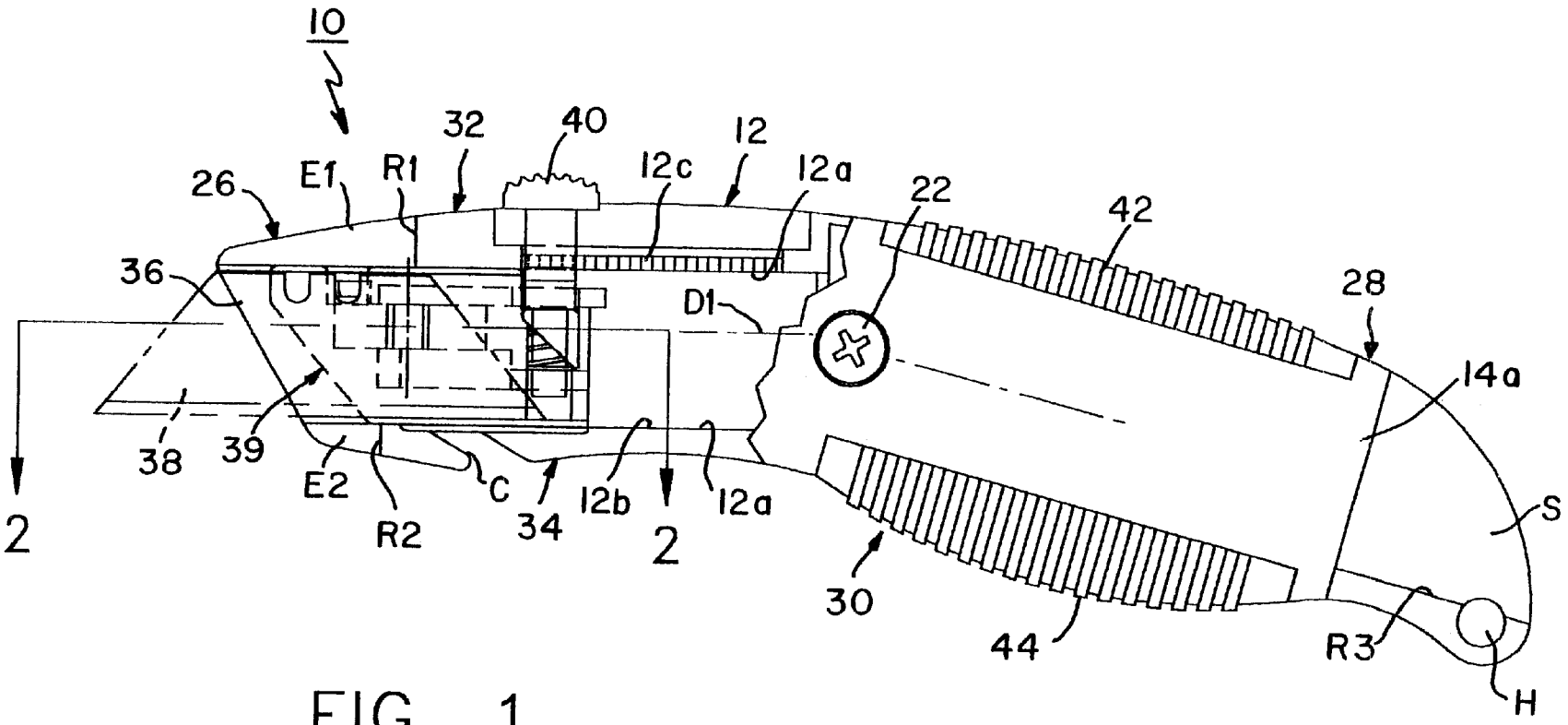
FIG. 1 is a side elevational view of the front-loading adjustable safety utility knife in accordance with the present invention with the front portion of the housing broken away to show the safety quick-release lock mechanism in accordance with the invention.

Referring now to the FIGS., in which identical or similar parts will be designated by the same reference numerals throughout, and first referring to FIG. 1, an adjustable safety utility knife in accordance with the present invention is generally designated by the reference numeral 10.

The utility knife 10 includes an elongated ergonomically shaped handle 12 formed of two elongate shell members 14*a,* 14*b,* each having a peripheral edge 16*a,* 16*b* (FIG. 2), respectively, and outer, generally convex surface 18*a,* 18*b* and an inner generally concave surface 20*a,* 20*b,* respectively. A suitable fastener, such as a transverse screw 22 (FIG. 1) is provided for fastening the shell members 14*a,* 14*b* to each other at the peripheral edges 16*a,* 16*b* (FIGS. 2A, 2B) along a vertical parting plane P (FIG. 2) to form an elongated internal cavity or compartment 24. The handle 12 defines a front end 26, a back end 28 and an intermediate portion 30 suitable to be gripped by the user, and also defining top and bottom surfaces 32, 34, respectively, extending along the top and bottom sides of the shell members 14*a,* 14*b* along the peripheral edges. The handle 12 has a conventional slot-like aperture 36 (FIG. 1) in the front end 26 substantially aligned with the parting plane P and dimensioned for passage of a flat cutting blade 38 therethrough. A guide member, in the form of a carriage 39, is provided within the cavity 24, at the front end 26, for guiding the cutting blade 38 between a first retracted position for safely storing the blade 40 inside of the cavity and an extended second position for selectively extending the blade beyond the aperture 36 for exposing a portion thereof, as shown in FIG. 1. The carriage for the blade is generally shown in FIG. 1, the details thereof being more fully shown in FIGS. 2A, 2B and 3. A manually operated button 40, of the type frequently used in utility knives of this kind, is arranged on the top surface 32 and coupled to the guide element or carriage 39 for selectively moving the blade 38 between the first and second positions.

Slip resistant elements 42, 44 are preferably secured between the shell members at the top and bottom surfaces 32, 34, respectively, between a rearward-most operative position of the manually operative button and the back end 28. The slip resistant elements 42, 44 generally conform to the outer convex surface 18*a,* 18*b* and enhance the gripping of the handle 12 and minimize slippage of the handle during use of the utility knife when gripped by the user.

As the shell members are fastened together by means of a single screw 22, the shell members are preferably provided with one or more cutouts or recesses in one of the shell members and extensions in the other shell member that mate therewith. In the embodiment illustrated in FIG. 1, the shell member 14*a* is provided at the front end 26 thereof with upper and lower recesses or cutouts R1, R2 that receive conforming transverse extensions E1, E2 which are integrally formed on the opposing shell member 14*b*. It will be appreciated that when the recesses and extensions mate and interlock as shown, it will be clear that the shell members will not have a tendency to rotate or shift in relation to each other.

The blade guide element or carriage 39 is arranged on suitable guide surfaces 12*a,* 12*b* (FIG. 1) for guiding the cutting blade carriage between a first position for safely storing the blade fully inside the cavity 24 and a second position for selectively extending the blade beyond the aperture 36 to expose at least a portion thereof, as shown in FIG. 1.

The manually operated button 40 is arranged on the top surface 32 and coupled to the guide element or carriage 39 for selectively moving the blade between the first and second positions, as to be described below.

Referring to FIG. 1, the housing is shown broken away to illustrate the general position of the blade guide member or carriage 39 within the elongated internal cavity 24 for supporting the flat cutting blade. Guide surfaces 12*a,* 12*b* (FIG. 1) are provided on at least one of the inner generally concave surface 20*a,* 20*b* for guiding the carriage 39 and cutting blade between the first and second or extended and retracted positions. A plurality of teeth 12*c* (FIG. 1) are provided along the longitudinal length direction D1 of the front end of the housing 12, the teeth being shown arranged along a straight or linear path for reasons to be more fully apparent hereafter.

Figure 2A:
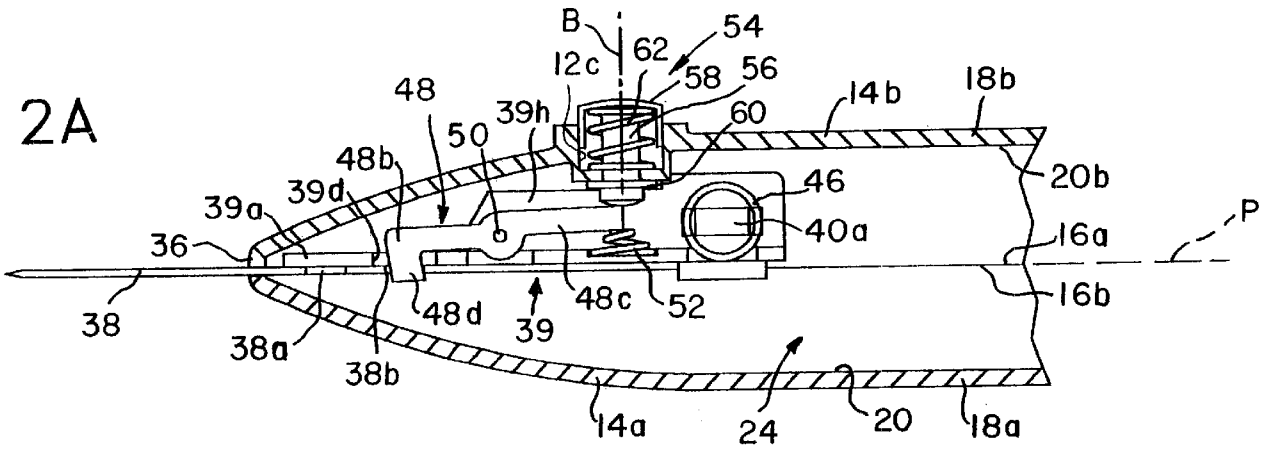
FIG. 2A is a cross sectional view of the front portion of the utility knife shown in FIG. 1, taken along line 2—2, illustrating the normal condition of the knife when no external manual force is applied to release the blade and, therefore, the blade is in a locked condition.
Figure 2B:
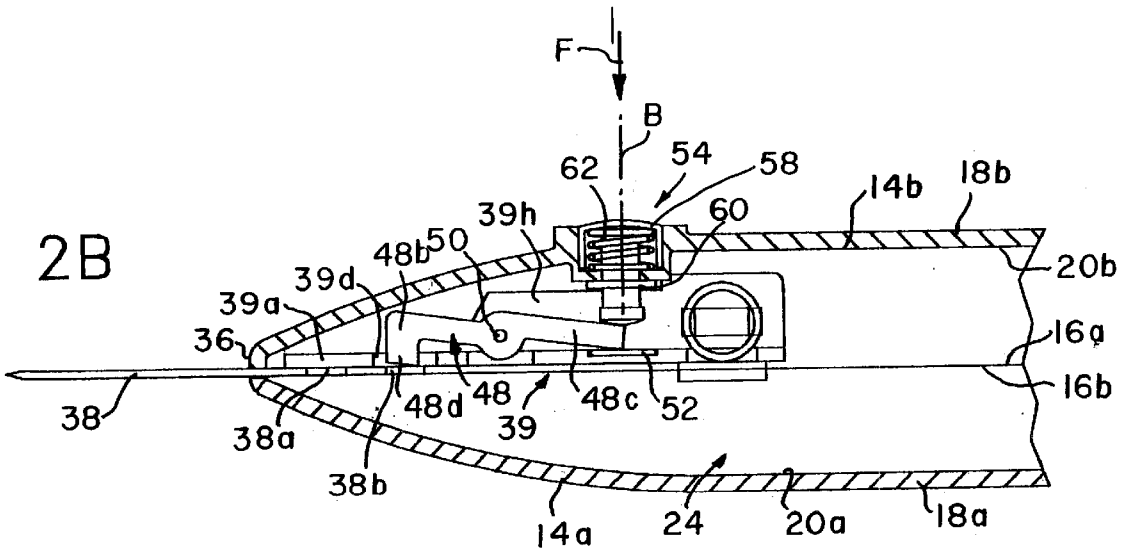
FIG. 2B is similar to FIG. 2A, but illustrates the condition of the elements or components of the quick-release lock mechanism when an external force is applied to the quick-release button, such as by a finger of the user.
Figure 3:
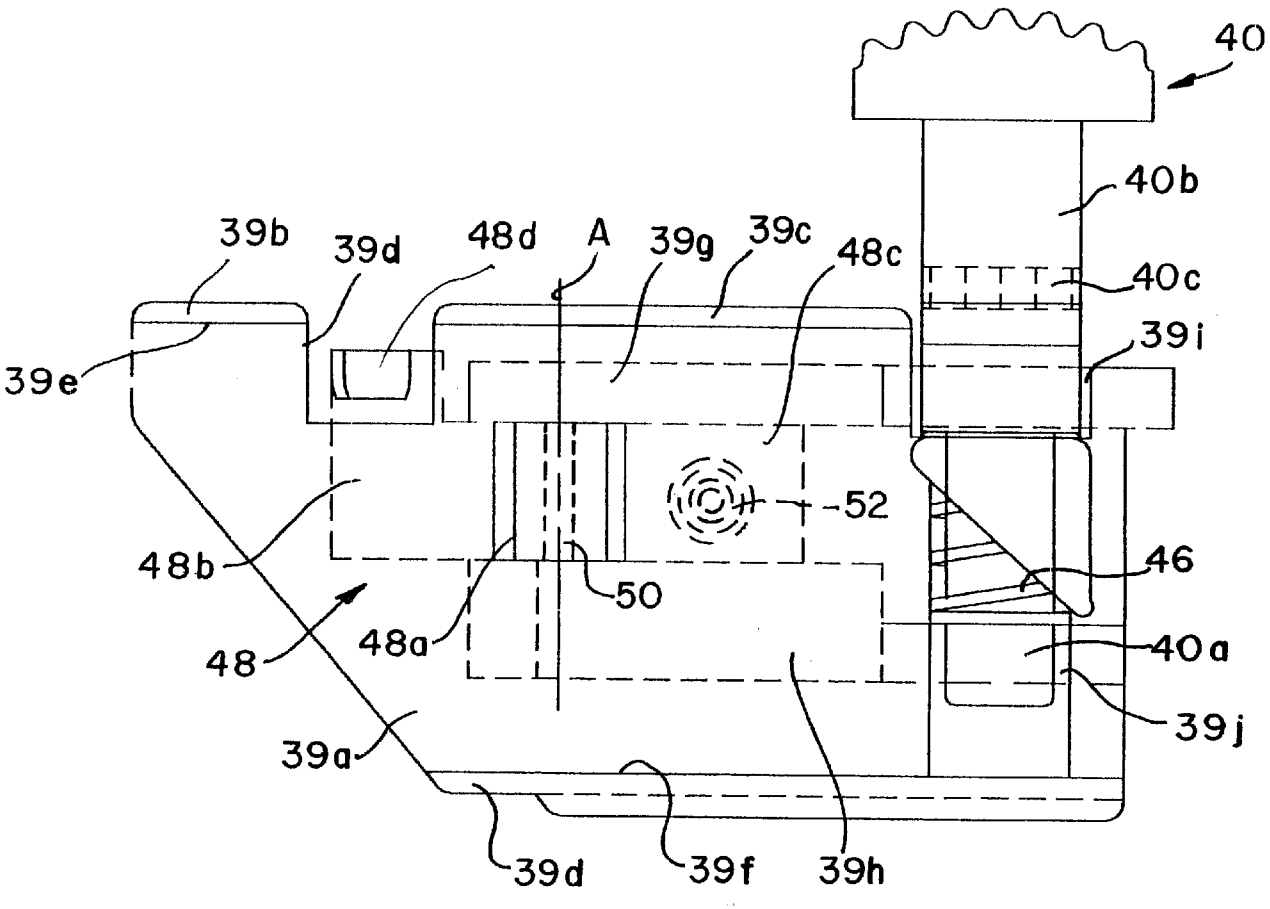
FIG. 3 is an enlarged side elevational view of the blade supporting carriage illustrated in FIGS. 1, 2A and 2B, shown in the normal condition when no force is applied to the upper button which unlocks the carriage from moving inwardly or outwardly along the handle within the cavity.

Referring to FIGS. 2A, 2B and 3, the details of the carriage 39 for enabling the safe and quick release of the blade 34 will be described. The carriage includes a substantially planar body 39*a* (FIG. 3), preferably formed of a metal, although other materials may be used. Spaced ribs or ledges 39*b,* 39*c* are generally aligned with each other as shown, and define a generally rectangular opening or space 39*d* within the body 39*a.* A lower ledge or rib 39*d* is provided which is parallel to the ribs 39*b,* 39*c,* the opposing ribs being spaced from each other to substantially correspond to the height of the blade 38 so that the blade can be received between the opposing ribs with small clearance. While the ribs 39*b*–39*d* project towards the shell 18*a* (out of the paper, as viewed in FIG. 3), the body 39*a* is provided with spaced and substantially parallel projections 39*g* and 39*h* which extend towards the shell member 18*b* (into the page, as viewed in FIG. 3). The projection 39*g* includes an opening 39*i* and the projection 39*h* includes an opening 39*j* to accommodate the stem 40*b* on which the button 10 is supported to enable the button and the stem to move vertically in relation to the body 39*a.* A helical compression spring 46, captured between the projections 39*g,* 39*h,* normally urges the button and stem to move upwardly in relation to the body 39*a,* bringing mating teeth 40*c* on the stem 40*b* to be generally aligned and interlocked with the teeth 12*c* on the housing of the handle 12. When so engaged or interlocked, the body 39*a* becomes locked in place and cannot move forwardly or rearwardly in relation to the handle. However, when the button 40 is depressed inwardly, the teeth 40*c* are moved downwardly in relation to the teeth 12*c* and the interlocking relationship is disrupted so that the user can slide the carriage 39 forwardly or rearwardly on the guides 12*a,* 12*b.*

An important feature of the invention is the provision of a pawl 48 which is provided with a vertical cylindrical boss 48*a* through which a vertical pin 50 extends between the projections 39*g* and 39*h* to render the pawl 48 pivotable about the axis A of the pin. The pawl includes a front portion 48*b* forwardly of the pin 50 and a rear portion 48*c,* rearwardly of the pin 50. A compression spring 52 is disposed between the body 39*a* and the rear portion 48*c* to normally rotate the pawl 48 in a counterclockwise direction when the carriage is viewed from the top. Such normal disposition of the pawl maintains a right angle finger 48*d* extending through the opening 39*d* a distance sufficient to engage one of the notches 38*a,* 38*b* formed in the upper edge of the blade 38. The finger 48*d,* therefore, normally locks the blade from moving longitudinally in relation to the carriage.

As indicated, therefore, the right angle finger 48*d,* which is in the nature of a lock or blocking element normally locks the cutting blade mounted thereon to substantially fix the cutting blade against relative longitudinal movements between the cutting blade and the carriage.

Referring to FIGS. 2A and 2B, a quick release mechanism 54 is illustrated on the shell member 18*b*. The quick release mechanism 54 includes a pin 56 extending through an opening 12*c* (FIG. 2A) in the shell member 18*b,* the pin 56 being slidably mounted along axis B generally normal to the axis A of the pin 50. A cap or button 58 is provided which covers the pin 56 and is provided with an exterior shape or configuration suitable for manual depression. The pin 56 may be secured to the wall of the shell member 18*b* in any suitable or conventional manner, washer 60 being shown, the end of the pin 56 extending inwardly beyond the washer 60 being enlarged in any conventional way, such as by flaring, to permit the pin to move inwardly into the cavity to the position shown in FIG. 2B but not to permit the pin from moving outwardly beyond the condition indicated in FIG. 2A. The axis B of the pin 56 is preferably aligned with the spring 52, the interior end of the pin 56 and spring 52 being arranged on opposite sides of the rear portion 48*c* of the pawl 48. Thus, when no exterior pressure is applied to the cap 58 and pin 56, a compression spring 52 is selected to be sufficiently strong to rotate the pawl 48 in a counterclockwise direction, as viewed in FIG. 2A, so that the locking finger 48*d* is received within an upper notch of the blade 38, while the pin 56 and cap 58 are urged outwardly to the maximum extent permitted by the washer 60. However, when it is desired to remove a blade 38 through the front opening or aperture 36, the carriage 39 must first be moved forwardly to align the pawl portion 48*c* and the spring 52 with the quick release button 54. Now the user presses the quick release button 54. This overcomes the biasing forces exerted by both the springs 52 and 62, rotating the pawl 48 in a clockwise direction as viewed in FIG. 2A to the condition shown in FIG. 2B. Now the locking finger 48*d* is removed or extracted from the upper notch of the blade 38. Under this condition, there is nothing retaining the blade 38 from longitudinal movements in relation to the carriage 39 and the blade may be easily and conveniently pulled forwardly out of the utility knife housing. The same procedure can be applied for inserting a new blade. As long as the cap 58 is maintained in a depressed position, by applied force F, the locking finger 48*b* is displaced from its normal position and provides a clear path for the blade to be either inserted or withdrawn. Once the blade is inserted into the unit, the cap 58 may be released and the blade locked in place as illustrated in FIG. 2A.

It will be appreciated that the above described quick release mechanism 54 overcomes the difficulty with some prior art designs in which some or all of the components or elements used to provide some of the functions described above are separable. Therefore, when the shell members 18*a,* 18*b* are removed or separated, the numerous components, including the springs, all separate and it becomes difficult or inconvenient to reassemble the elements in a way that makes them readily functionable. With the present design, the carriage 39 is made as a single unitary unit, all of the components described, with the exception of the release mechanism or button 54, are all mounted on the body 39*a* of the carriage 39. Therefore, if the shell members 18*a,* 18*b* are separated, it becomes a simple matter to simply reposition the body 39*a* on the guide ledges 12*a,* 12*b* and the unit can be quickly and conveniently reassembled since all of the springs, the pawl, etc., are all permanently mounted on the body 39*a.*

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What we claim:

1. An adjustable safety utility knife comprising an elongated ergonomically shaped handle formed of two elongate shell members each having a peripheral edge and an outer generally convex surface and an inner generally concave surface; fastening means for fastening said shell members at said peripheral edges along a vertical parting plane to form an elongated internal cavity, said handle defining a front end, a back end and an intermediate portion suitable for being gripped by a user and also defining top and bottom surfaces extending along opposite sides of said shell members along said peripheral edges, said handle having a slot-like aperture at said front end substantially aligned with said parting plane and dimensioned for passage of a flat cutting blade therethrough; guide means within said elongated cavity for guiding the cutting blade between a first position for safely storing the blade fully inside said cavity and a second position for selectively extending the blade beyond said aperture to expose at least a portion thereof; a manually operated button arranged on said top surface and coupled to said guide means for selectively moving the blade between said first and second positions, said guide means including a carriage within said elongated internal cavity for supporting a flat cutting blade and guide elements on at least one of said inner generally concave surfaces for guiding said carriage and cutting blade carried thereby between said first and second positions, said carriage including locking means for normally locking a cutting blade mounted thereon to substantially fix said cutting blade against relative longitudinal movements between said cutting blade and carriage, said locking means including an unlocking element the actuation of which releases said cutting blade to permit relative longitudinal movements between said cutting blade and said carriage; and blade release means on one of said shell members for actuating said unlocking element when manual force is applied thereto, whereby application of a force on said release means releases said cutting blade and enables it to be withdrawn through said front end aperture.

2. An adjustable safety utility knife according to claim 1, wherein said carriage is coupled to said guide means.

3. An adjustable safety utility knife according to claim 1, wherein said carriage slidably receives a cutting blade with small clearance, said flat cutting blade having an aperture therein and said carriage including a locking finger normally extending through said aperture to prevent relative longitudinal movements between said blade and said carriage, said locking finger being removable from said aperture when a pressure is applied to a predetermined portion of said carriage; and a releasing button on one of said shell members normally biased outwardly to clear said carriage and being manually depressible to apply a pressure on said predetermined portion when said carriage is in a preselected position in said handle proximate to said front end, whereby movement of said carriage to said preselected position in said handle and manually depressing said releasing button removes said locking finger from engagement with said cutting blade and permits same to be withdrawn from said carriage and said handle through said front aperature.

4. An adjustable safety utility knife according to claim 1, wherein said carriage is made as a unitary assembly.

* * * * *